US008240397B2

(12) United States Patent
Crawford et al.

(10) Patent No.: US 8,240,397 B2
(45) Date of Patent: Aug. 14, 2012

(54) METHOD TO CONTROL BIT LOAD

(76) Inventors: James R. Crawford, Lafayette, LA (US); Benton Frederick Baugh, Houston, TX (US)

( * ) Notice: Subject to any disclaimer, the term of this patent is extended or adjusted under 35 U.S.C. 154(b) by 386 days.

(21) Appl. No.: 12/459,665

(22) Filed: Jul. 7, 2009

(65) Prior Publication Data

US 2011/0005834 A1 Jan. 13, 2011

(51) Int. Cl.
*E21B 21/08* (2006.01)
*E21B 44/06* (2006.01)

(52) U.S. Cl. ..... 175/38; 175/48; 175/94; 175/100

(58) Field of Classification Search ..... 175/94, 175/100, 107, 215, 38, 48
See application file for complete search history.

(56) References Cited

U.S. PATENT DOCUMENTS

| | | | | |
|---|---|---|---|---|
| 2,233,692 | A * | 3/1941 | Bryant | 175/210 |
| 3,823,788 | A * | 7/1974 | Garrison et al. | 175/94 |
| 6,374,838 | B1 | 4/2002 | Baugh | |
| 6,561,280 | B1 | 5/2003 | Baugh et al. | |
| 2005/0098349 | A1 * | 5/2005 | Krueger et al. | 175/25 |

OTHER PUBLICATIONS

U.S. Appl. No. 12/218,053, filed Jul. 11, 2008, Crawford.

* cited by examiner

*Primary Examiner* — Giovanna Wright

(57) ABSTRACT

The method of controlling the load on a drill bit drilling a hole by providing differential pressure across a seal area on a drilling assembly to increase the bit load and providing a relief valve from the annular area above the seal to the bore returning fluid to the surface to limit the maximum differential pressure to limit the maximum load allowed.

8 Claims, 3 Drawing Sheets

METHOD TO CONTROL BIT LOAD

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention is that of moving pipe into a generally horizontal hole and drilling at the end of the hole. The distance at which the pipe can be pushed into a generally horizontal hole is limited by the forces available and the column buckling characteristics of the pipe.

Pipes are used to push in horizontal directions for activities such as drilling in oil and gas wells as holes are drilled horizontally thru shallow but wide pockets or reservoirs of oil or gas. Once the wells are drilled, cleanout or secondary production operations can be enhanced by a smaller string of tubing being inserted into the horizontal runs. The use of the smaller but faster strings has been limited due to the limited load which can be put on a bit at the end of the tubing.

A variety of other pipes exist in which improved "bit load" can be useful includes sewage systems, water lines, and pipelines.

Especially in the case of thin wall pipe such as coiled tubing which can be unreeled into a pipe, column buckling strength is low. As the pipe is not actually assured of being straight in the first place, column buckling resulting in a spiral configuration in the well will cause high friction with the wall of the hole. This friction will limit and/or stop forward movement of the pipe, and eliminate or limit the end loading available to a drilling bit at the end of the tubing.

When the generally horizontal hole begins with a vertical hole such as in an oil or gas well, the transmission of force around the curve between vertical and horizontal further limits the forces available in the generally horizontal section.

BRIEF SUMMARY OF THE INVENTION

The object of this invention is to provide a method which will provide a forward motive force for tools and pipes which are in generally horizontal holes.

A second object of the present invention is to provide a motive force which will increase the load on a drill bit while the drill bit is drilling.

A third object of the present invention is to provide a method of limiting the increased bit load to a maximum amount.

DETAILED DESCRIPTION OF THE INVENTION

Figure 1:
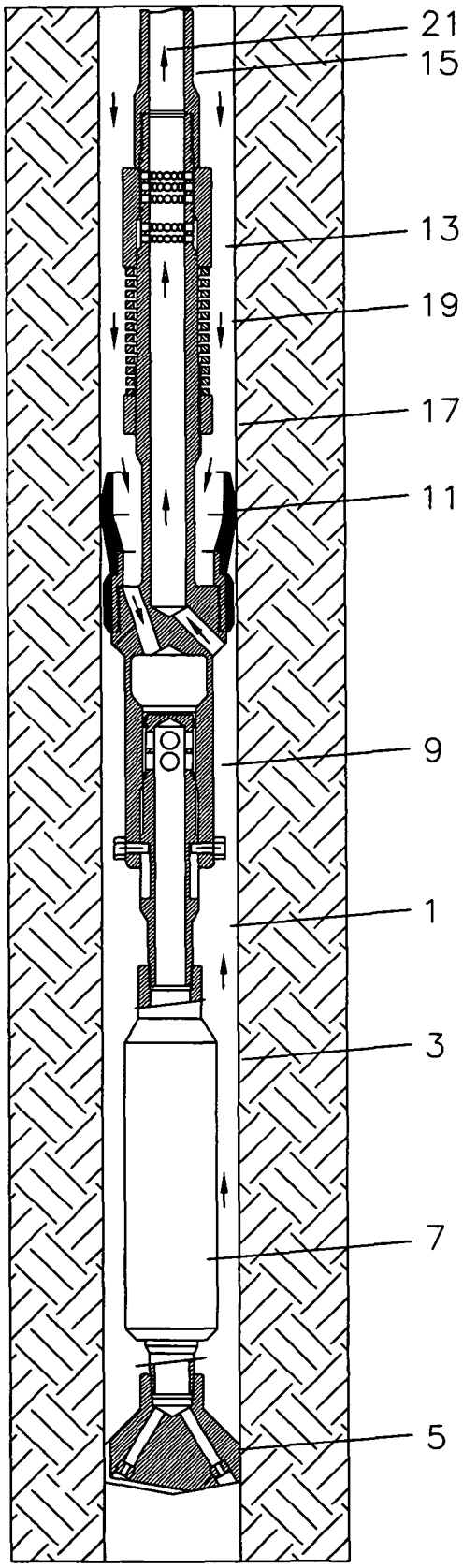
FIG. 1 is a section of the earth showing the system moving in a well to be drilled.

FIG. 1 shows a drilling system 1 in a bore 3. The bore can be an oil or gas well bore, a pipeline, or other tubular hole. The drilling system generally comprises a drill bit 5, a drill motor 7, a flow valve 9, a sealing cup 11, relief valve 13, and a drilling tube 15.

FIG. 1 shows the drilling assembly moving in the bore 3 towards the area to be drilled. To some extent it can be pushed forward by the drilling tube 15, however in horizontal wells or pipelines the distance that it can be pushed forward is limited by the column buckling of the drilling tube 15. In the present invention, sealing cup 11 seals on the internal bore 17 of the bore 3 and allows pumping in the annular area 19 against sealing cup 11 to provide a motive force forward. Fluid in front of the drilling assembly 1 is vented back into the drilling tube 15 as shown at 21. In this way the drilling assembly 1 can be moved to an extended reach location for drilling which it cannot be pushed to.

Figure 2:
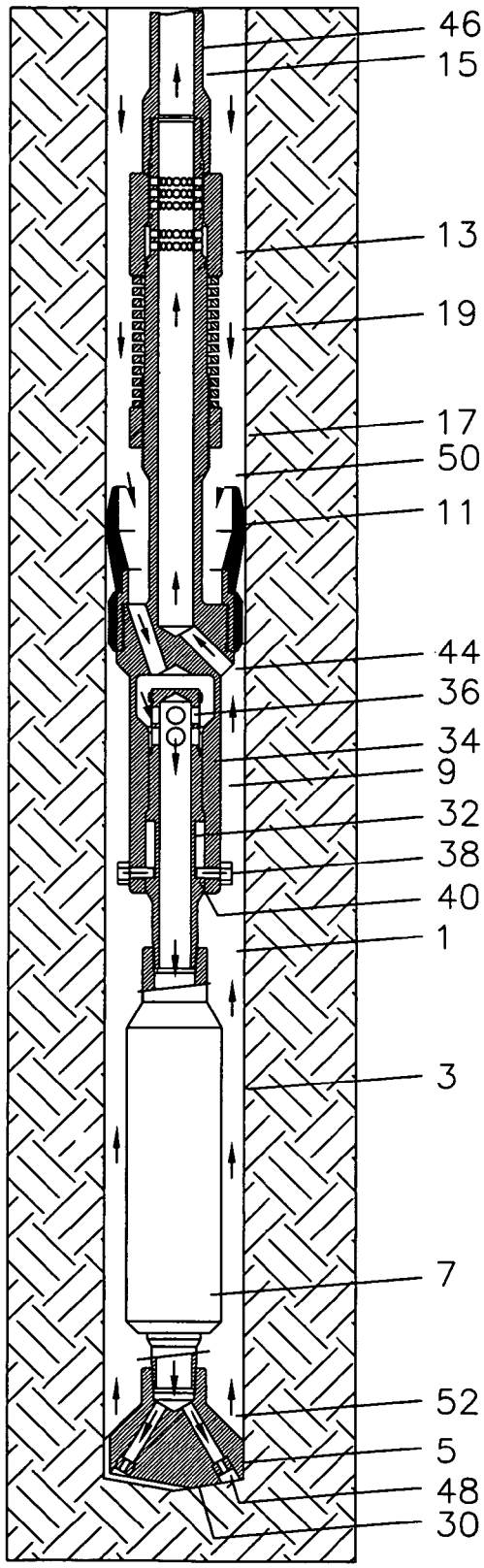
FIG. 2 is a section of the earth showing the system drilling at low flow rates which increase the bit load but do not activate the relief functions of the present invention.

FIG. 2 shows the drilling assembly 1 after it reaches the drilling location and the drill bit 5 contacts the end of the hole 30. The drill bit 5, drill motor 7, and inner sleeve 32 of valve 9 stop moving forward. Outer sleeve 34 of flow valve 9, sealing cup 11, relief valve 13, and drilling tube 15 continue to move forward until ports 36 on flow valve 9 are opened and stop bolts 38 hit the bottom of slots 40. When this happens flow 42 goes from the annular area 19, through the drill motor 7 to turn the drill bit 5, thru the drill bit 5, back up through port 44, and into the internal bore of the drilling tube 15, and back to the location where the drilling tube 15 entered the bore 3.

After the drilling fluid is pumped along the annular area between the internal bore 17 of the bore 3 and the outer surface 46 of the drilling tube 15, it goes through the drill motor 7 to rotate the drill bit 5 and through restrictive jetting nozzles 48 of bit 5. This flowing pressure loss causes a reduction of the pressure at 50 to a lower pressure at 52. This differential in pressure is seen across the seal 11, and this differential pressure results in a differential force in the direction towards the drill bit 5.

Drilling requires a load on the bit to effectively cause drilling. Drilling at this time will be facilitated by any bit load which the drilling tube 15 can push, plus the force caused by the differential pressure across sealing cup 11. When drilling in needed at a distance further than the drilling tube 15 can push, the only drilling load on the drill bit 5 will be the force which comes from the differential pressure.

Figure 3:
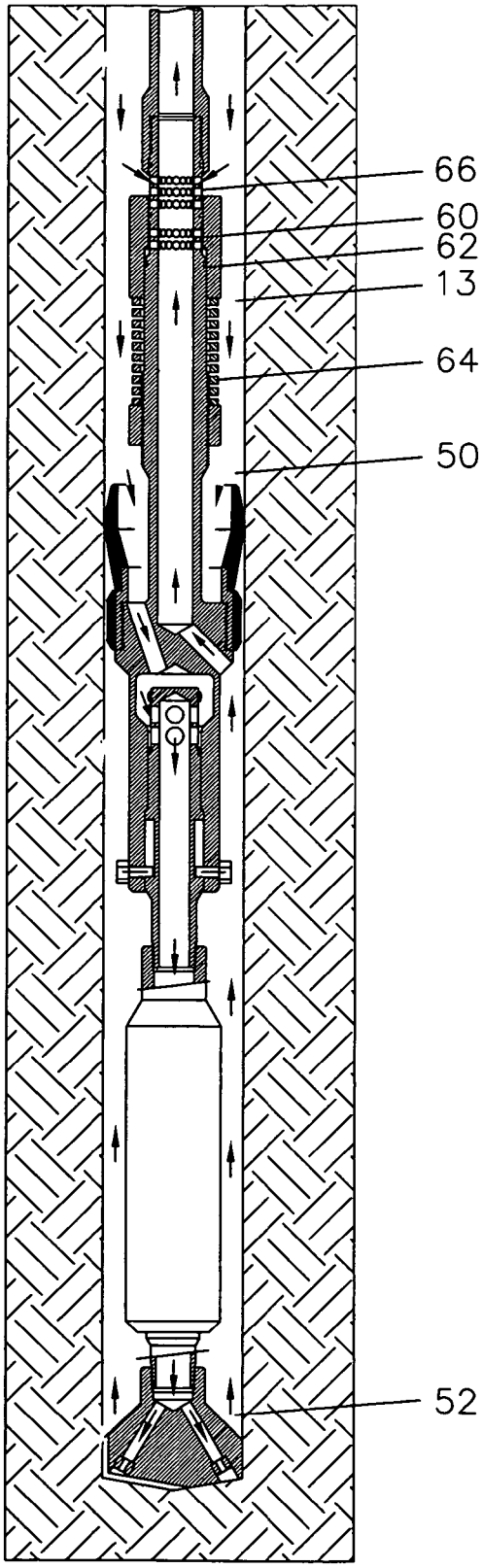
FIG. 3 is a section of the earth showing the system drilling at higher flow rates which increase the bit load and activate the relief functions of the present invention.

Referring now to FIG. 3, when the pressure differential becomes too great, the bit will be overloaded and the drill motor will be stopped. At extended reach distances the flow losses are difficult to predict exactly as distances, bore sizes, fluid viscosities and other factors are not easy to control. The operator can have a good idea as to what the maximum bit load should be, but needs assistance in actually achieving it. Relief valve 13 provides a piston area between diameters 60 and 62 which provide an opening force which is offset by a spring 64. The pressure on the outside of the relief valve 13 is approximately the pressure which was indicated at 50. The pressure on the inside of the relief valve 13 is approximately the pressure which was indicated at 52. When the differential pressure between 50 and 52 exceeds a predetermine amount, flow is diverted thru ports 66 to limit the flow volume which passes through the drill motor 7 and the drill bit 5. As flow is diverted through ports 66, the differential pressure between 50 and 52 is limited and the bit load is limited.

Without this method of limiting the maximum pressure, the operator would be required to estimate the appropriate flow rate considering the annulus flow loss, the drill motor pressure differential, the loss across the jet nozzles, the flow loss within the drilling tube, and the viscosity of the drilling fluid. The likely result will be so low a bit load that drilling is ineffective or so high a bit load that the motor is stopped from turning. Controlling the differential and therefore bit load at the drilling assembly makes it much easier to optimize the drilling operations.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. A method of controlling loading on a drill bit drilling a hole having an inner diameter with a drilling tube having an outer diameter and an internal bore, comprising:

an annular area between said outer diameter of said drilling tube and said inner diameter of said hole being drilled, circulating drilling fluids from said proximate location to said distal location in said annular area, loading said drill bit against the end of said hole to be drilled with pressure from the flow of said drilling fluids, and limiting said bit load by venting a portion of said flow within said annular area into said internal bore of said drilling tube.

2. The method of claim 1, further comprising controlling said venting by a pressure regulator.

3. The method of claim 2, further comprising a first pressure in said annulus area and a second pressure in said inner bore of said drilling tube, said pressure regulator operating as a function of the difference said first pressure and said second pressure in said inner bore of said drilling tube.

4. A method of controlling loading on a drill bit drilling a hole having an inner diameter, comprising:

providing a drilling tube having an outer diameter, an inner bore, an end at a proximate location and an end at a distal location, providing a drilling bit on the end of said drilling tube at said distal location, an annular area between said outer diameter of said drilling tube and said inner diameter of said hole being drilled, circulating drilling fluids from said proximate location to said distal location in said annular area, loading the drill bit against the end of the hole to be drilled with pressure from the flow of said drilling fluids, directing said flow of drilling fluids thru said drill bit, and providing a valve to control said flow of drilling fluids to said drill bit which is urged to a closed position by said flow in said annular area and is urged to an open position when said drill bit engages the bottom of said hole to be drilled.

5. A method of controlling loading on a drill bit drilling a hole with an inner wall, comprising:

providing a drilling tube having an outer diameter, an inner bore, an end at a proximate location and an end at a distal location, having an annular area between said outer diameter of said drilling tube and said inner wall of said hole, providing a drilling assembly comprising a drilling bit having an outlet side, a drill motor having an inlet side, and a seal with a seal area to sealingly engage said inner wall of said hole being drilled, said seal having a proximate side and a distal side, pumping a flow of drilling fluids from said proximate location along said annular area between said outer diameter of said drilling tube and said inner wall of said hole through said seal, through said drill motor, and thru said drilling bit and returning to said proximate location through said inner bore of said drilling tube, said flow of said drilling fluid through said drill motor and said drilling bit causing a higher pressure near said inlet side of said drill motor and a lower pressure near said outlet side of said drilling bit, exposing said higher pressure to said proximate side of said seal area and exposing said lower pressure to said distal side of said seal area, the difference in pressure from said proximate side of said seal area to said distal side of said seal area causing a force to urge said drilling assembly toward the end of said hole being drilled, and limiting the bit load by venting a portion of said flow within said annular area into the internal bore of said drilling tube.

6. The method of claim 5, further comprising controlling said venting by a pressure regulator.

7. The method of claim 6, further comprising said pressure regulator operating as a function of the difference in said higher pressure and said lower pressure.

8. A method of controlling loading on a drill bit drilling a hole with an inner wall, comprising:

providing a drilling tube having an outer diameter, an inner bore, an end at a proximate location and an end at a distal location, having an annular area between said outer diameter of said drilling tube and said inner wall of said hole, providing a drilling assembly comprising a drilling bit, a drill motor having an inlet side, and a seal with a seal area to sealingly engage said inner wall of said hole being drilled, said seal having a proximate side and a distal side, pumping a flow of drilling fluids from said proximate location along said annular area between said outer diameter of said drilling tube and said inner wall of said hole through said seal, through said drill motor, and thru said drilling bit and returning to said proximate location through said inner bore of said drilling tube, said flow of said drilling fluid through said drill motor and said drilling bit causing a higher pressure near said inlet side of said drill motor and a lower pressure near the outlet side of said drilling bit, exposing said higher pressure to said proximate side of said seal area and exposing said lower pressure to said distal side of said seal area, the difference in pressure from said proximate side of said seal area to said distal side of said seal area causing a force to urge said drilling assembly toward the end of said hole being drilled, directing said flow of drilling fluids thru said drill bit, and providing a valve to control said flow of drilling fluids to said drill bit which is urged to a closed position by said flow in said annular area and is urged to an open position when said drill bit engages the bottom of said hole to be drilled.

* * * * *